United States Patent [19]

Smith

[11] Patent Number: 4,735,021

[45] Date of Patent: Apr. 5, 1988

[54] ABRASIVE BLASTING SYSTEM

[75] Inventor: Edward J. Smith, Hinckley, Ohio

[73] Assignee: A.L.C. Co., Inc., Medina, Ohio

[21] Appl. No.: 862,305

[22] Filed: May 12, 1986

[51] Int. Cl.[4] ..... B24C 7/00

[52] U.S. Cl. ..... 51/438; 51/410; 51/436

[58] Field of Search ..... 51/410, 438, 439, 436, 51/427, 415

[56] References Cited

U.S. PATENT DOCUMENTS

| | | | |
|---|---|---|---|
| 1,205,237 | 11/1916 | Maliha . | |
| 1,303,178 | 5/1919 | Dunham . | |
| 1,543,827 | 6/1925 | Doty . | |
| 1,899,528 | 2/1933 | Rosenberger | 51/436 |
| 2,395,420 | 2/1946 | Myers | 51/12 |
| 2,753,664 | 7/1956 | Garver | 51/8 |
| 3,070,924 | 1/1963 | Hastrup | 51/8 |
| 3,201,901 | 8/1965 | Pauli | 51/12 |
| 3,557,498 | 1/1971 | Lindsay | 51/8 |
| 3,704,553 | 12/1972 | Hehr et al. | 51/11 |
| 3,924,657 | 12/1975 | Assersen | 137/596.15 |
| 4,080,761 | 3/1978 | Burns | 51/438 |

FOREIGN PATENT DOCUMENTS

| | | |
|---|---|---|
| 945589 | 5/1949 | France . |
| 1183342 | 3/1970 | United Kingdom . |

*Primary Examiner*—Frederick R. Schmidt
*Assistant Examiner*—Robert A. Rose
*Attorney, Agent, or Firm*—Fay, Sharpe, Beall, Fagan, Minnich & McKee

[57] ABSTRACT

An abrasive blasting system which includes an improved mixing and control valve assembly together with an improved manually operable discharge nozzle assembly. The mixing and control valve assembly comprises a housing defining first and second chambers connected by a generally circular opening. An abrasive particle inlet and an outlet are formed in the second chamber. A stem extends axially through the opening between the first and second chambers to define an open annular passageway through which pressure fluid supplied to the first chamber passes in a swirling motion to mix with the abrasive particles in the second chamber and impel them out the outlet. A valve member carried by the stem is arranged for selective engagement with the outlet to stop flow through the assembly. The discharge nozzle assembly includes means for controlling actuation of the mixing valve and is provided with a lever-type operating handle and an associated lever arranged to automatically assume a safety lock position and prevent inadvertent actuation of the operating handle.

16 Claims, 2 Drawing Sheets

FIG. 7
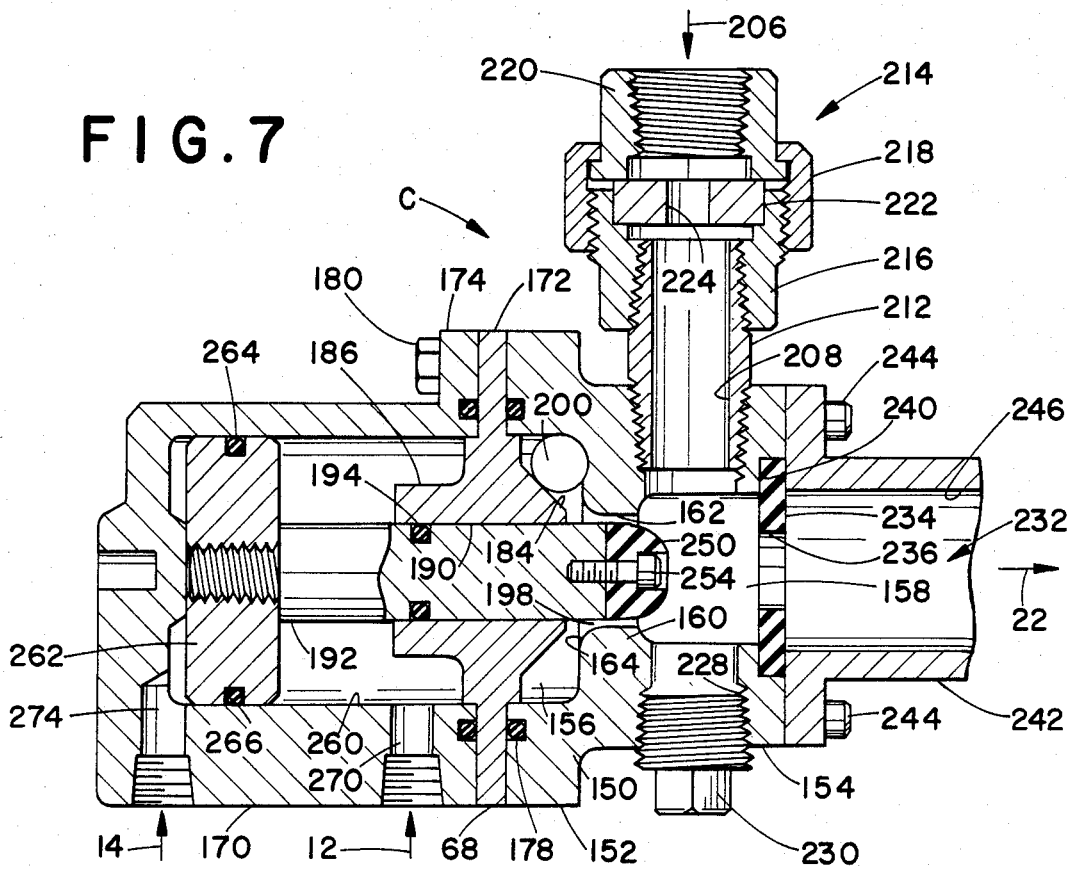
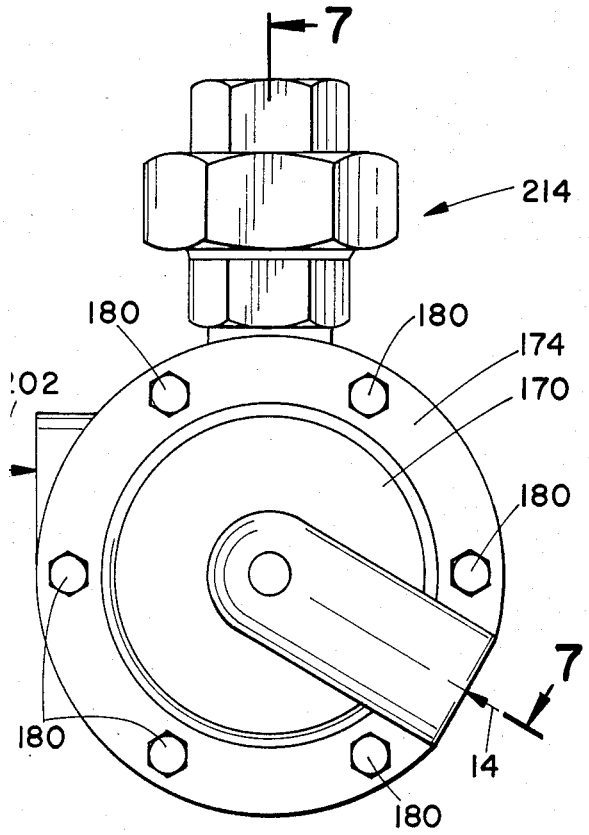
FIG. 5
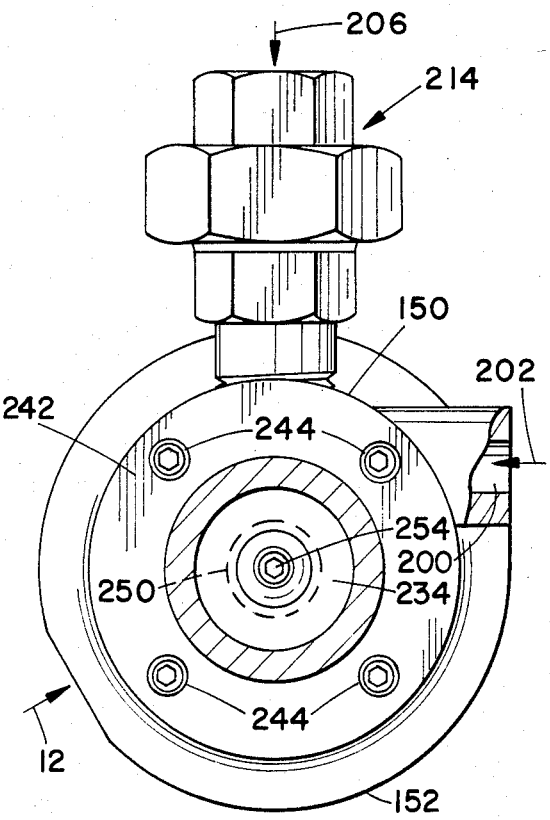
FIG. 6

ABRASIVE BLASTING SYSTEM

BACKGROUND OF THE INVENTION

The subject invention is directed toward the art of abrasive blasting systems and, more particularly, to an improved arrangement for mixing and controlling the supply of an abrasive particle and pressure fluid mixture to a blast nozzle.

A variety of different abrasive blasting systems are known in the art. Generally, such systems include apparatus for supplying abrasive particles from a reservoir and mixing them with a high pressure fluid such as pressurized air to impel them through a manually manipulated discharge nozzle. Many different types of mixing and control valve arrangements have been proposed for use in such systems. Typically, however, such systems have suffered from a variety of problems including poor mixing of the abrasive particles and pressure fluid, high rates of wear on the various system parts, and, difficulties associated with controlling the flow of the mixture to the discharge nozzle assembly.

The subject invention overcomes the above and other problems and provides an abrasive blasting system which is comparatively simple and highly reliable. The subject system assures extremely efficient mixing of the abrasive particles and the pressure fluid while providing rapid and effective control of the blasting fluid to the discharge nozzle assembly.

SUMMARY OF THE INVENTION

In particular, the subject invention comprises and abrasive blasting system having an improved mixing and control assembly for regulating the mixing of abrasive particles supplied from a pressurized source with a high pressure fluid and conducting the mixture to a manually operable abrasive discharge nozzle and control assembly. Preferably, the inventive system includes a housing which defines first and second chambers connected by a generally circular opening. A stem means extends through the first chamber into the opening in axial alignment therewith to define an annular fluid flow passageway between the first and second chambers. Inlet means are provided for supplying abrasive particles from a pressurized source thereof to the second chamber. The second chamber also includes an outlet for discharging a mixture of abrasive particles and pressure fluid from the second chamber to a remotely located discharge nozzle and control assembly. The first chamber is adapted to be connected with a pressure fluid supply source for producing a spiraling flow of pressure fluid through the annular passageway into the second chamber for mixing with and impelling abrasive particles through the outlet means.

Preferably, and in accordance with a more limited aspect of the invention, the stem means carries a valve member adapted to be moved toward and away from the outlet to selectively block flow through the outlet. Preferably, both the pressure fluid and the abrasive particles are supplied to the second chamber under substantially the same pressure. Consequently, merely by controlling the outlet of the second chamber the flow of the abrasive particle and pressure fluid mixture to the discharge nozzle assembly can be regulated without separate controls for either the pressure fluid supply or the pressurized abrasive particle supply. That is, when the outlet from the mixing chamber is closed flow of pressure fluid and pressurized particles to the chamber ceases as the system becomes pressure balanced.

In accordance with a further aspect of the invention, the stem means is moved to selectively open or close the outlet by a fluid actuator which is adapted to be controlled by valve means carried by a manual discharge nozzle and control assembly.

Preferably, and in accordance with a more limited aspect of the invention, the discharge nozzle and control assembly includes a manually manipulatable elongated body having a central flow passage terminating in a discharge nozzle. Valve means are carried by the body and include an operating member movable between first and second positions and adapted for regulating the flow of pressure fluid to the previously mentioned fluid power actuator. The valve operating member is movable between its first and second positions by a first manually operable lever mounted on the exterior of the body for pivotal mvoement about a first axis between first and second positions. Associated with the first lever are biasing means for continually biasing the first lever toward the first position. Carried by and operable with the first lever are means for causing the valve operating member to be moved to its second position when the first lever means is moved to its second position.

In order to prevent the first lever means from being inadvertently moved to its second position, the discharge nozzle and control assembly includes a second manually operable lever mounted on the body for pivotal movement about a second axis parallel to the first axis and spaced therefrom. Spring means are provided to continually bias the second lever to a position in which it is adapted to block movement of the first lever to its second position. Preferably, the second lever is provided with an opening in its outer terminal end. The first lever includes a terminal end portion which is adapted to extend through the opening in the second lever when the first lever is in its first position. Preferably, the first lever is related to the body such that it can be moved toward the body to the second position by merely grasping both the body and the lever with one hand. In addition, the relationship between the first lever and the second lever is such that the second lever can be moved to a release position with the same hand that actuates the first lever. Specifically, the terminal end of the blocking lever is arranged to extend radially outwardly beyond the first lever at a location such that the index finger of the hand which actuates the first lever can move the second lever to a release position.

As is apparent from the foregoing, the primary object of the subject invention is the provision of a highly simplified and reliable abrasive blasting system.

Another object is the provision of a mixing and control valve assembly for abrasive blasting systems wherein the pressure fluid is supplied to the unit in a manner which assures highly effective mixing with the abrasive particles and wherein the control of the outlet from the unit can be effected from the remotely located nozzle assembly.

A further object is the provision of a system of the type described which does not require separate controls for the pressure fluid and abrasive particle supplies.

Yet another object is the provision of a discharge nozzle and control assembly for an abrasive blasting system wherein inadvertent actuation of the discharge nozzle is prevented by a unique arrangement of actuating and locking levers.

BRIEF DESCRIPTION OF THE DRAWINGS

The above and other objects and advantages will become apparent from the following description when read in conjunction with the accompanying drawings wherein:

FIG. 5 is an end view of the abrasive mixing control valve assembly (the view is taken on line 5—5 of FIG. 1);

FIG. 6 is a right-hand end view of the abrasive mixing and control valve assembly of FIG. 1 (the view is taken on line 6—6 of FIG. 1); and, FIG. 7 is a cross-sectional view taken on line 7—7 of FIG. 5.

DETAILED DESCRIPTION OF THE PREFERRED EMBODIMENT

Figure 1:
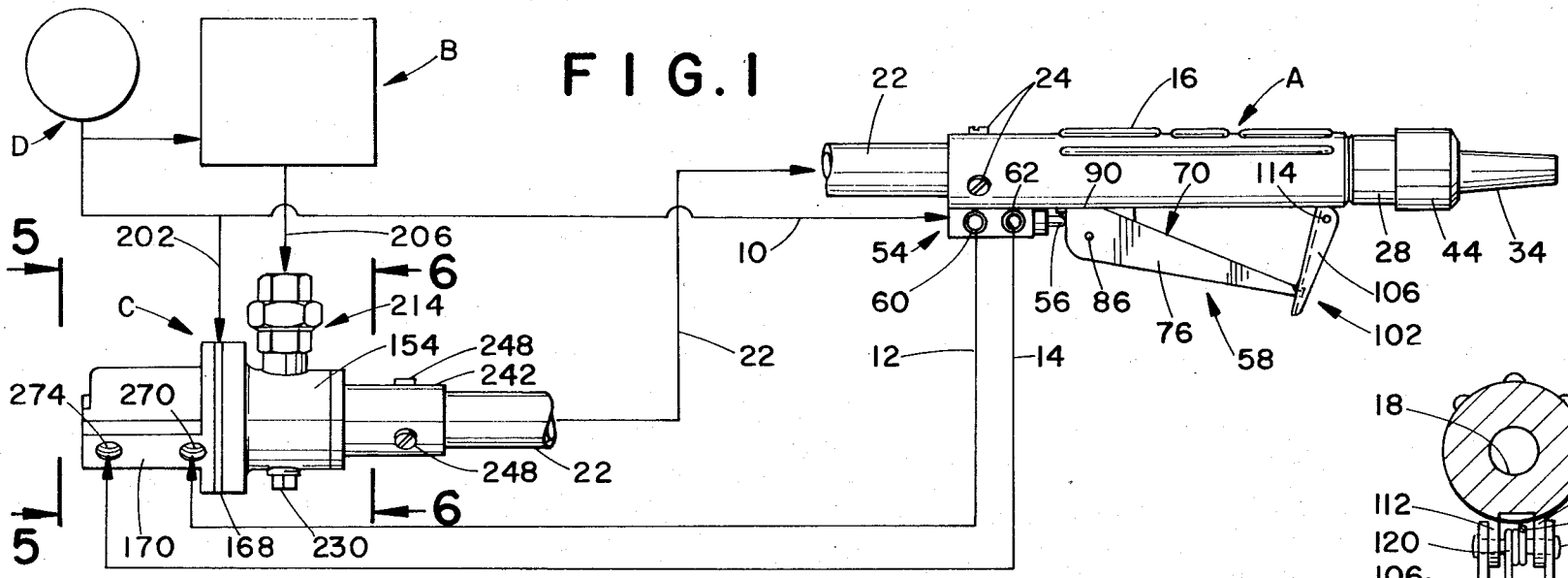
FIG. 1 is an overall view, partially diagrammatic, showing an abrasive blasting system formed in accordance with a preferred embodiment of the invention.

Referring more particularly to the drawings wherein the showings are for the purpose of illustrating a preferred embodiment of the invention only and not for the purpose of limiting same, FIG. 1 shows the overall arrangement of an abrasive blasting system which is formed in accordance with the preferred embodiment and includes a manually manipulatable discharge nozzle and control assembly A which is provided with a suitable high pressure mixture of pressure fluid and abrasive particles. The abrasive particles used in the mixture, for example, sand, glass beads, or the like, are supplied from a conventional pressurized supply B connected to the nozzle assembly A through an abrasive mixing and control valve assembly C. Abrasive mixing and control valve assembly C functions to control the flow of abrasive mixture to the discharge nozzle and control assembly A while mixing the abrasive particles with a pressurized fluid such as compressed air supplied to assembly C from a conventional compressor system or pressurized air supply source D. In the subject embodiment, control of the abrasive mixing and control valve assembly C is effected from discharge nozzle and control assembly A which includes means for controlling the flow of pressurized air from source D and line 10 to a pair of air lines 12 and 14 connected with the abrasive mixing and control valve assembly C. The details of the control assembly will subsequently be described in greater detail.

Figure 2:
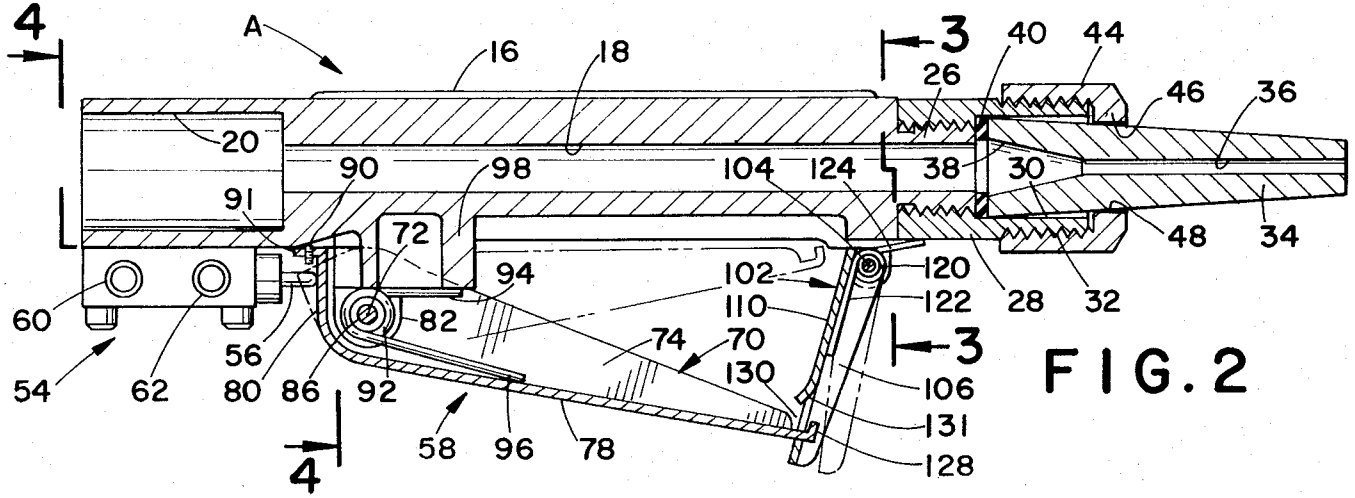
FIG. 2 is a longitudinal cross-sectional view of the discharge nozzle and control assembly of the FIG. 1 embodiment.
Figure 3:
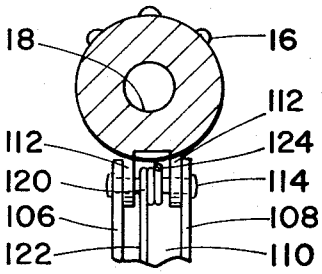
FIG. 3 is a cross-sectional view taken on line 3—3 of FIG. 2.
Figure 4:
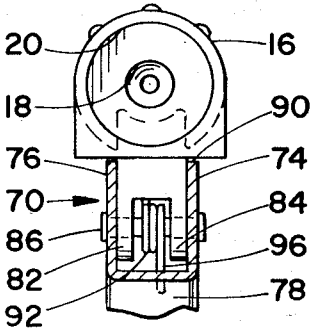
FIG. 4 is a view taken on line 4—4 of FIG. 2.

Referring in particular to FIGS. 2-4, the overall arrangement and preferred construction for the discharge nozzle and control assembly A can best be understood. In particular, as shown, the assembly A comprises an elongated, generally cylindrical main body 16 provided with a central, generally axially extending passageway 18. While it should be appreciated that the body 16 could be formed from a variety of different materials, in the subject embodiment it is preferably a die cast aluminum component.

The left-hand or inlet end of passageway 18 (as viewed in FIG. 2) includes an enlarged counterbore 20 which is sized so as to releasably receive the end of a conventional, flexible high pressure blast hose assembly 22 which conducts the abrasive particle and compressed air mixture from the mixing and control valve assembly C to the discharge nozzle and control assembly A. Suitable screws 24 or other conventional fastening means are provided to releasably connect the terminal end of blast hose 22 with the body 16.

The right-hand end of body 16 terminates in a reduced diameter threaded end portion 26. A nozzle adaptor element 28 is received on threaded end portion 26. Preferably, nozzle adaptor 28 has an outer diameter substantially equal to that of the body 16 and forms a continuation thereof as shown in FIG. 1. The adaptor 28 has its outer end provided with a counterbore 30 and exterior threads 32. Counterbore 30 is sized so as to closely receive a replaceable discharge nozzle member 34. As shown, nozzle 34 includes a central, axially extending through-opening 36 which joins to an enlarged conical inlet opening 38. The outer periphery of the left-hand end of nozzle 34 is sized so as to be closely received within counterbore 30 of adaptor 28. Preferably, a resilient sealing gasket 40 is positioned between the bottom of counterbore 30 and the end surface of nozzle 34 to provide a fluid seal between the end of the nozzle and the end of reduced diameter portion 26 of body 16. The nozzle 34 is releasably retained in adaptor 28 by a retaining nut or cap member 44 which has internal threads sized so as to engage with threads 32 of adaptor 28. In addition, member 44 includes a radially inward extending shoulder 46 having an inner opening 48 sized to engage the tapered outer surface of the nozzle 34.

As can be appreciated, in the typical fluid blasting system the nozzle assembly is generally used some distance from the associated abrasive particle supply and mixing equipment. For this reason, means are preferably directly associated with the nozzle to permit the person manipulating the nozzle assembly to control the associated blast fluid supply equipment. In the subject embodiment, these means comprise a control member 54 which is carried on main body 16 and arranged for actuation by a handle and safety lock assembly 58. While many different types of control units 54 could be used, in the subject embodiment unit 54 comprises a conventional, commercially available control valve having an inlet and a pair of outlets controlled by an outwardly biased operating element 56. In the subject system the valve has its inlet connected with line 10 and its outlets 60 and 62 respectively connected with lines 12 and 14. When the operating stem 56 is in the outer or solid line positions shown in FIGS. 1 and 2, compressed air flow from line 10 is directed through outlet 62 to line 14. When the control element 56 is moved to the left (as viewed in FIGS. 1 and 2) flow from line 10 is directed through outlet 60 to line 12. By selective control of flow to lines 12 and 14 the supply of the pressure fluid and abrasive particle mixture to discharge nozzle and control assembly A is regulated in a manner described more particularly hereafter.

The actuating handle and safety lock assembly 58, which actuates to control unit 54, can best be understood with reference to FIGS. 2-4. Specifically, the assembly 58 includes a first, main handle or lever member 70 mounted for pivotal movement about an axis 72 which extends generally transversely of body 16. As shown, lever 70 is sized and arranged such that it can be actuated toward the body 16 by an operator manually grasping about the body and the lever 70 and squeezing the lever toward the body. In the embodiment shown, lever 70 has a generally U-shaped cross-section including spaced side walls 74 and 76 joined by a transverse web 78 (see FIG. 4). As best shown in FIG. 2, web section 78 is smoothly contoured into a back wall or actuating portion 80.

The lever 70 could be connected to an supported by the body 16 in a variety of different ways. In the subject embodiment, however, the body 16 is provided with a pair of downwardly extending leg members 82 and 84 which are spaced apart a distance such that they are closely received between the side walls 74, 76 of lever 70. A suitable roll pin 86 is received in correspondingly located openings in members 82 and 84. The outer ends of pin 86 extend through suitable openings in the side walls 74, 76 of lever 70.

In the embodiment shown, outward pivotal movement of the lever 70 is adjustably limited by a small screw 90 carried in a threaded opening formed through a tab 91 extending from back wall 80. The inner end of screw 90 is arranged to engage the outer periphery of body 16 when handle 70 is in the position shown in solid lines in FIGS. 1 and 2. Tab 91 and screw 90 are laterally offset from actuating member 56 so as not to interfere with the operation thereof.

Lever 70 is continually biased toward the outermost, solid line position by a torsion spring 92 carried on pin 86 and having radially extending leg portions 94 and 96. As shown in FIG. 2, leg portion 94 bears against the underside of a downwardly extending portion 98 of body 16. Leg 96 is similarly engaged with web 78 of lever 70.

The lever 70 is mounted and arranged relative to valve 54 such that when lever 70 is in the outermost solid line position, the valve operating member 56 is in the position wherein flow through line 10 is directed to outlet 62 and line 14. However, when lever 70 is moved inwardly toward body 16 to the dotted line position shown in FIG. 2, the actuating surface 80 of lever 70 acts to move operating member 56 to cause flow from line 10 to be directed through outlet 60 to line 12 and flow through outlet 62 to be terminated. As will subsequently be discussed, the system is arranged such that line 12 actuates mixing and pressurization of control assembly C to supply a high pressure fluidized media through line 22 to assembly A.

In order to prevent inadvertent inward movement of lever 70, and undesired discharge of the fluidized media, the apparatus includes a second, somewhat smaller lever 102 which is carried by body 16 and mounted for pivotal movement about a second axis 104 parallel to, and spaced from previously mentioned axis 72. Like lever 70, lever 102 has a generally U-shaped cross-section and includes spaced side walls 106 and 108 connected by a transverse web 110 (see FIGS. 2 and 3). The lever 102 is pivotally connected to and supported from a pair of downwardly extending legs or tab members 112 which are preferably formed integrally with body 16. In the embodiment shown, a suitable roll pin 114 extends through suitable openings formed in legs 112 and side members 106 and 108 of lever 102. The upper edges of side members 106, 108 and web member 110 form stop surfaces to limit the counterclockwise movement of lever 102 (as viewed in FIG. 2). These stop surfaces are arranged to engage the underside of body 16 and prevent movement of the lever 102 clockwise beyond the solid line position shown in FIGS. 1 and 2. The lever 102 is continually biased in the clockwise direction to the solid line position by a torsion spring 120 which is positioned between legs 112 about the pivot pin 114. As shown, spring 120 includes outwardly extending end portions 122 and 124 which engage web 110 of lever 102 and the underside of body 16, respectively.

Referring in particular to FIG. 2 it will be noted that the outer free end portions of levers 70 and 102 includes interengaging portions arranged to prevent inward pivotal movement of lever 70 when lever 102 is in the solid line position. Specifically, according to the preferred embodiment, the outer free end of lever 70 includes an extension portion 128 formed to pass through an opening 130 formed in web portion 110 of lever 102. Preferably, the end 128 is provided with a generally hook-like configuration. As can be appreciated, with end portion 128 engaged in opening 130, attempted inward pivoting movement of lever 70 is prevented by engagement of the hook end portion 128 with the inner wall 131 of opening 130. Preferably, the edge of inner wall 131 of opening 130 is bent outwardly and curved as shown to provide a smooth, cam-like contour for engagement by hook end portion 128. To permit movement of lever 70 inwardly, the lever 110 must first be pivoted to at least the dotted line position shown in FIG. 2 to thereby free end portion 128 and permit lever 70 to be pivoted inwardly.

Preferably, and as shown in FIG. 2, the outer free end of lever 102 extends radially outwardly beyond the radial extend of lever 70. This arrangement facilitates release of the lever 102 when it is desired to actuate lever 70 inwardly. Note that because of the positioning of lever 102 it is possible to grip body 16 and lever 70 with one hand and use the index finger of the same hand to push lever 102 to its dotted line position while simultaneously squeezing lever 70 inwardly toward body 16. Conversely, however, any inadvertent forces applied separately to either lever 70 or lever 102 can normally not produce an inward movement of lever 70. For example, kicking, dropping or bumping the actuating lever 70 or lever 102 in a direction to pivot lever 70 toward the body causes an innerlock between the hook portion of lever 70 and the inner wall of opening 130.

An aspect of the subject invention which is of significant importance to the overall system is the functioning and arrangement of the abrasive mixing and control valve assembly C. The preferred construction and arrangement of assembly C can best be understood by reference to FIGS. 5–7. As shown therein, the assembly preferably includes a first housing component 150 which has a generally cylindrical outer configuration including a first large diameter end portion 152 and a second somewhat smaller diameter end portion 154. A first, generally cylindrical chamber 156 is formed to extend axially inwardly of the left-hand end of member 150 as viewed in FIG. 7. A second chamber 158 is formed to extend axially inwardly in alignment with chamber 156 from the right-hand end of member 150. As shown, chambers 156 and 158 are divided by a radially inwardly extending continuous wall 160 which defined a generally circular opening 162 between chamber 156 and 158. Preferably, and for reasons subsequently to become apparent, the periphery of opening 162 in the chamber 156 is smoothly contoured or rounded as shown generally at 164.

The left-hand end of chamber 156 is closed by a generally cylindrical end wall member 168 and a second housing component 170. As shown, wall member 168 includes a continuous circumferential flange section 172 sized to correspond to the outer diameter of end portion 152 of housing component 150. A similar radially extending flange portion 174 is formed on the right-hand end of housing component 170 as viewed in FIG. 7. Housing components 150 and 170 are sealed relative to wall member 168 by suitable O-rings 178 received in corresponding grooves formed in components 150 and 170 and bearing against the outer faces of flange 172 of wall member 168. Preferably, wall member 172 and second housing component 170 are releasably connected to housing component 150 such as by a plurality of machine screws 180 best seen in FIG. 5.

Referring again to FIG. 7, it will be noted that the central portion of wall member 168 has a portion 184 which is inclined and extends axially into chamber 156 as shown. Extending axially from the opposite side of wall member 168 is a boss portion 186.

Formed axially through wall member 168 is a cylindrical opening 190 which is aligned with the previously mentioned circular opening 162. Slidably carried within opening 190 is a shaft member 192 provided with a circumferential groove and an O-ring 194. Shaft member 192 is sized so that the right-hand end thereof extends axially into circular opening 162 in wall 160 and, in combination therewith, defines an annular flow passage 198.

In the embodiment under consideration, chamber 156 is the pressure fluid inlet chamber and chamber 158 functions as the mixing chamber for mixing the pressure fluid, in this case air, with abrasive particles supplied from the pressurized abrasive particle supply means B. For reasons which will subsequently be discussed, pressure fluid from pressurized fluid source D is supplied to chamber 156 through an inlet opening 200 which opens generally tangentially into chamber 156 as shown. In the embodiment under consideration, pressurized air is supplied from line 10 (see FIG. 1) to opening 200 by a connecting line 202.

Pressurized air supplied through opening 200 enters chamber 156 and receives a high velocity swirling motion because of the relationship of the inlet to the general cylindrical chamber. The swirling air passes about the inner end of shaft 192 and enters mixing chamber 158 through the annular passageway 162. The inclined wall 184 and contoured corner 164 on opening 162 provide a smooth flow transition from chamber 156 to annular passage 198.

A continuous supply of abrasive particles are conducted to chamber 158 through a pipe or supply line 206. In the embodiment under consideration, the abrasive particles are directed radially into chamber 158 through an opening 208. Opening 208 is joined with line 206 through a short pipe nipple 212 and a coupling assembly 214. Coupling assembly 214 includes a first coupling component 216 threaded to the end of nipple 212 and receiving a threaded collar member 218. As shown, collar 218 clampingly retains a second coupling component 220 in assembled relationship with first coupling component 216. Positioned between coupling components 216 and 220 is an orifice plate member 222. In the embodiment under construction, orifice plate member 222 is preferably formed from a metal, such as steel. It should be appreciated that other suitable materials could be used, however. The orifice plate member 222 includes a central opening 224 which functions to somewhat meter the flow of abrasive particles to chamber 158.

Aligned with inlet opening 208 is a second threaded opening 228 which is normally closed by a removable threaded pipe plug 230. Opening 228 and plug 230 provide access to chamber 158 for cleaning and the like.

As can be appreciated, the abrasive particles entering chamber 158 are impacted by the swirling high pressure air entering the chamber through the annular opening 162. This creates a swirling intermixing of the high pressure air and the abrasive particles and impels the mixture axially out of chamber 158 through outlet 232 and line 22 to the discharge nozzle and control assembly A.

In the embodiment shown, the outlet 232 from chamber 158 is defined by an annular member 234 having a central opening 236. The member 234 is received in a circumferential recess or counterbore 240 formed circumferentially about the right-hand end of chamber 158. It is clampingly retained in counterbore 240 by an adaptor member 242 releasably connected to the housing component 150 by a plurality of machine screws 244 (see FIG. 6). As shown, member 242 is provided with a central opening 246 which is sized to closely receive the end of hose 22 (see FIG. 1). Hose 22 is releasably held in opening 246 in an appropriate manner such as through the use of screws 248 as shown in FIGURE 1.

According to the subject invention, flow through the chamber 158 to the discharge nozzle and control assembly A is controlled by controlling the outlet of air and abrasive particles from chamber 158. Preferably, according to the embodiment shown, the member 234 is adapted to serve as a valve seat element. In addition, a valve member 250 is carried on the end of shaft 192. In the subject embodiment, valve element 250 and the seat defining member 234 are both formed from rubber having a hardness preferably in the range of 45–50 Durometer. As shown, element 250 is releasably connected to the inner end of shaft 192 in any convenient manner such as through the use of a machine screw 254. Additionally, the end of member 250 is preferably rounded as shown.

As can be seen, by moving stem 192 to the right, as viewed in FIG. 7, valve element 250 engages with member 234 to block the flow of the air and abrasive particle mixture from chamber 158. Because the high pressure air being supplied through line 200 and the abrasive particle mixture being supplied through line 206 are both at the same pressure, flow ceases to chamber 158 and the discharge of the air abrasive mixture from the discharge nozzle and control assembly A ceases almost immediately thereafter.

Many different arrangements could be used for selectively moving the stem member 192 toward and away from the seat defining element 234. In the subject embodiment, movement of the stem member is provided by a fluid actuator, controlled by controlling the air pressure in lines 12 and 14. In particular, as best shown in FIG. 7, housing component 170 has an internal chamber which defines a pressure cylinder 260. Carried on the end of shaft 192 within cylinder 260 is a piston member 262 arranged for sealed reciprocation within cylinder 260. In the embodiment shown, piston 262 is threadedly retained on the end of shaft 192 and includes an O-ring 264 suitably mounted in a circumferential groove 266.

As can be seen, when pressure is supplied to cylinder 260 on the right-hand side of piston 262, as viewed in FIG. 7, the piston and shaft 192 are moved to the solid line position and flow is permitted through mixing chamber 158 to line 22. However, when pressure on the right side of the piston is released and pressure applied to the left-hand side of the piston, the piston and shaft 192 are moved to the right causing the valve element 250 to engage and seal the outlet opening 236. As mentioned earlier, the necessary pressure control is supplied through lines 12 and 14. Specifically, as shown in FIG. 7, a suitable inlet opening 270 is connected with line 12 to supply pressure from line 12 to cylinder 260 on the right-hand side of piston 262. Line 14 is similarly connected through an inlet opening 274 with the cylinder 260 on the left-hand side of piston 262.

As is apparent from the foregoing, the subject system provides an extremely simple and highly effective arrangement for mixing and controlling the supply of pressurized abrasive fluid to the discharge and control assembly A. Simply by controlling the flow of air to control lines 12 and 14, control of abrasive particles to assembly C are automatically controlled. In addition, the invention provides an extremely simple and effective mixing of the pressure air and abrasive particles.

The invention has been described in great detail sufficient to enable one of ordinary skill in the art to make and use the same. Obviously, modifications and alterations of the preferred embodiment will occur to others upon a reading and understanding of the specification. It is intended to include all such modifications and alterations insofar as they come within the scope of the appended claims or the equivalents thereof.

Having thus described the invention, it is now claimed:

1. An abrasive blasing system comprising:

housing means defining first and second chambers connected by a generally circular opening;

an elongated circular stem means having a longitudinal axis adapted to extend through said first chamber into said opening in axial alignment therewith to define an annular fluid flow passageway between said first and second chambers;

inlet means opening to said second chamber at a location spaced from said annular fluid flow passageway for supplying abrasive particles to said second chamber;

outlet means for discharging abrasive particles from said second chamber; and, pressure fluid supply means connected to said first chamber comprising a pressure fluid inlet which enters said first chamber at a location remote from the longitudinal axis of said stem means, additionally comprising means for producing a helical flow of pressure fluid through said annular passageway into said second chamber for mixing with and impelling abrasive particles therein through said outlet means.

2. An abrasive blasting system as defined in claim 1 including valve means for selectively opening and closing said outlet means.

3. An abrasive blasting system as defined in claim 2 wherein said valve means is carried by said stem means.

4. An abrasive blasting system as defined in claim 3 wherein said outlet means is axially aligned with said annular passageway and wherein said stem means is mounted for movement toward and away from said outlet means.

5. An abrasive blasting system as defined in claim 4 including fluid power means for moving said stem toward and away from said outlet means.

6. An abrasive blasting system as defined in claim 5 including a discharge nozzle means connected to said outlet means; and control means associated with said discharge nozzle means for controlling said fluid power means.

7. A mixing assembly for use in an abrasive blasting system comprising:

housing means defining first and second chambers connected by a generally circular opening;

an elongated stem means having a longitudinal axis extending axially through said opening between said first and second chambers to define an open annular passageway;

an outlet means formed in said second chamber;

an abrasive particle inlet means opening to said second chamber at a location between said open annular passageway and said outlet means; and, a pressure fluid inlet means connected to said first chamber at a location remote from said longitudinal axis of said stem means, additionally comprising means for producing a helical flow of pressure fluid through said open annular passageway into said second chamber for mixing with the abrasive particles supplied through said inlet means and expelling said abrasive particles through said outlet means.

8. The mixing assembly as defined in claim 7 wherein said first and second chambers are generally cylindrical and axially aligned with said opening.

9. The mixing assembly as defined in claim 7 wherein said outlet means is axially aligned with said annular passageway and including a valve member for selectively blocking flow through said outlet means.

10. The mixing assembly of claim 9 wherein said stem means is mounted for movement axially of said first and second chambers and wherein said valve member is carried by said stem means.

11. The mixing assembly of claim 10 including power means for moving said stem member and said valve member toward and away from said outlet means.

12. The mixing assembly of claim 11 wherein said stem means has terminal ends and extends axially of said first chamber to a position wherein one terminal end is outwardly of said second chamber and the other terminal end is adapted to move from a first position in said opening to a second position adjacent said outlet means.

13. The mixing assembly of claim 10 wherein said power means includes a piston connected to said stem means.

14. The mixing assembly of claim 7 wherein said abrasive particle inlet means opens radially into said second chamber at a location closely adjacent said annular passageway.

15. The mixing assembly of claim 14 wherein said outlet means comprises a circular outlet opening of a diameter less than the diameter of said annular passageway and axially aligned therewith.

16. The mixing assembly of claim 15 wherein stem means comprises a rigid cylindrical member extending axially through said first chamber and having a terminal end carrying a valve member adapted to be selectively engaged with said circular outlet opening to block flow therethrough.

* * * * *